United States Patent [19]

Svensson

[11] 4,237,824

[45] Dec. 9, 1980

[54] CENTRAL HEATING FURNACE

[76] Inventor: Ernst S. Svensson, Hedebo, Heda, S-599 00 Ödeshög, Sweden

[21] Appl. No.: 966,609

[22] Filed: Dec. 5, 1978

[30] Foreign Application Priority Data

Dec. 8, 1977 [SE] Sweden ..... 7713914

[51] Int. Cl.[3] ..... F22B 21/00

[52] U.S. Cl. ..... 122/235 R; 122/236

[58] Field of Search ..... 122/235 R, 235 A, 232, 122/233, 236, 238

[56] References Cited

U.S. PATENT DOCUMENTS

| | | | |
|---|---|---|---|
| 1,746,711 | 2/1930 | Murray | 122/235 A |
| 2,170,349 | 8/1939 | Bailey | 122/235 R |
| 3,107,656 | 10/1963 | McNeal | 122/236 |
| 3,703,161 | 11/1972 | O'Connor | 122/235 R |
| 3,810,447 | 5/1974 | Grainger | 122/235 R |
| 4,123,995 | 11/1978 | Ek | 122/235 R |

*Primary Examiner*—Henry C. Yuen

*Attorney, Agent, or Firm*—Laff, Whitesel & Rockman

[57] ABSTRACT

A central heating furnace has an outer casing, a tube system containing the heat carrying medium and a burner, e.g. an oil-burner, to heat this medium. The tube system is placed along the major part of the inner surfaces of the casing. The burner is so placed, in connection with the furnace, that in operation its flame will be directed vertically downwards and is thereby surrounded by a tube spiral communicating with the tube system containing the heat carrying medium.

4 Claims, 7 Drawing Figures

CENTRAL HEATING FURNACE

This invention relates to a central heating furnace, comprising an outer casing enclosing a system of tubes communicating with each other and containing the heat carrying medium. The tube system is placed along at least the major part of the inner surfaces of the casing. A burner, for instance an oil-burner, is used in the furnace for heating the heat carrying medium. In one exemplary system, the heat-carrying medium might be water.

It is a substantial object of the invention to provide a central heating furnace, in which the energy consumption for heating the heat carrying medium is considerably reduced, which means that the efficiency of the furnace is substantially increased.

According to the invention the burner is placed so that, in operation, its flame is directed substantially vertically downwards and is surrounded by a spiral tube having its direction substantially corresponding to the direction of the flame. The tube spiral communicates with the tube system containing the heat carrying medium.

The above features of the invention will appear more fully hereinafter from the following detailed description, when taken in conjunction with the accompanying drawings, in which.

Figure 1:
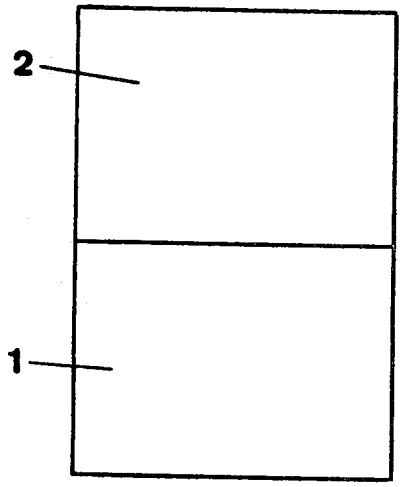
FIG. 1 is a front elevation view of a central heating furnace according to the invention.
Figure 2:
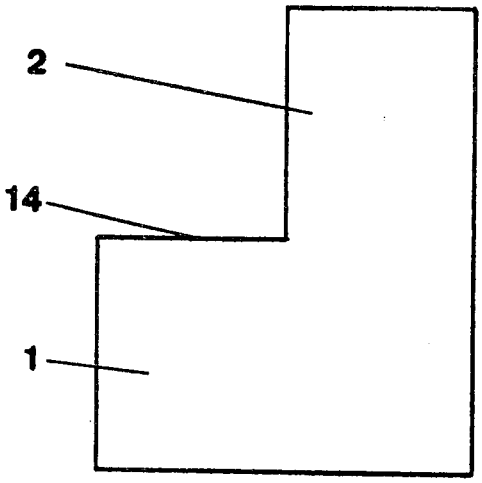
FIG. 2 is a side view of the same furnace.
Figure 3:
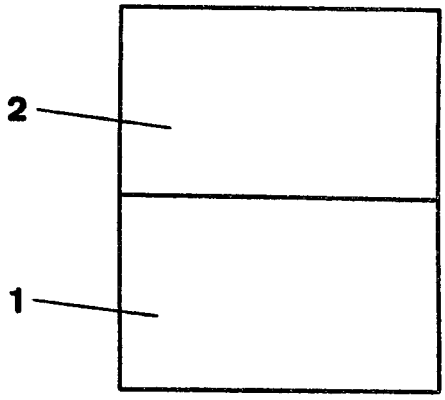
FIG. 3 is a top plan view of the same furnace.

In the central heating furnace according to the above FIGS. 1–3 the outer casing for the furnace is shaped as a lower, box-like front part 1 and a higher, box-like rear part 2. Both parts have plane and parallel sides and form together an integrated unit. Along at least the major part of the inner surface of the casing is placed a tube system, preferably made of copper, for carrying water. This tube system is best disclosed by FIGS. 5–7. The outer edges or the frame of the tube system is made of tubes having relatively large diameter, whereas all the tubes inserted in the frame have a smaller diameter. All these tubes communicate with each other and are filled with water.

Figure 5:
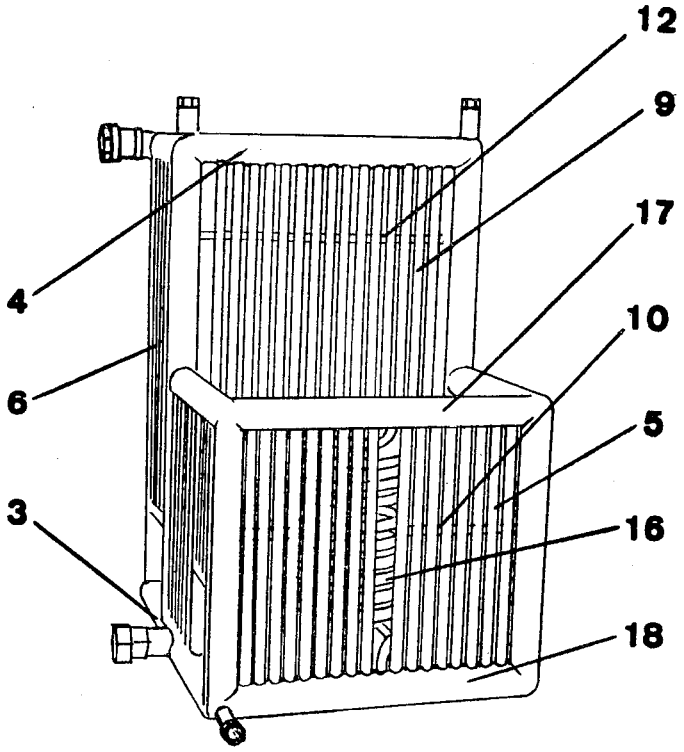
FIG. 5 is the same tube system shown as a front and left side perspective.
Figure 6:
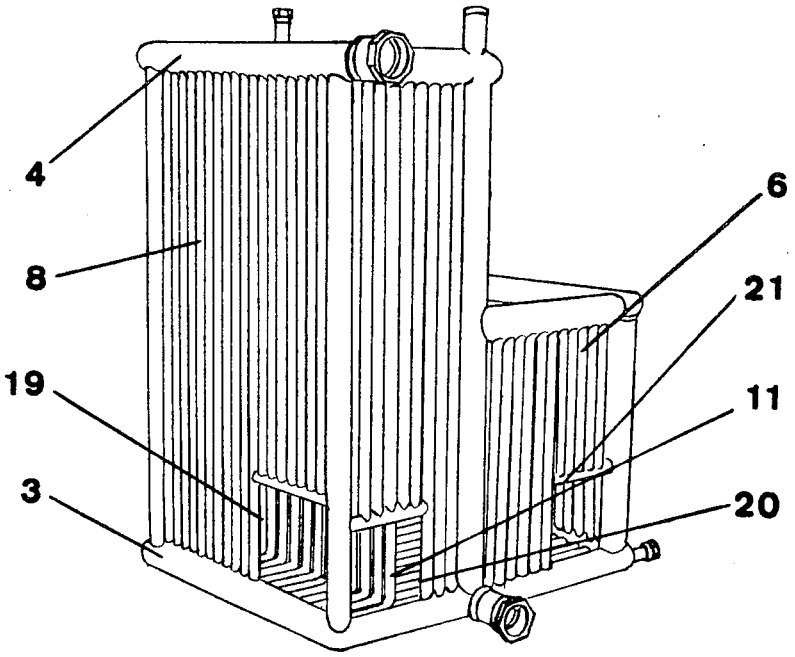
FIG. 6 is the same tube system shown as a back and left side perspective.
Figure 7:
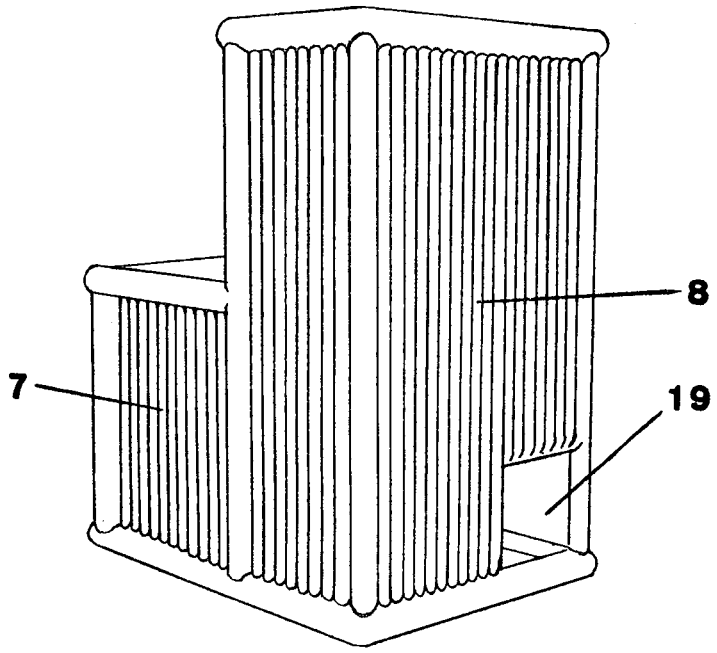
FIG. 7 is the same tube system, shown as a back and right side perspective.

All the vertical tube planes have the tubes directed vertically, the bottom plane has the tubes directed from the front to the back and the top plane has the tubes directed transversely from side to side. In this example tubes have been omitted from the top of the front part 1. FIGS. 5–7 show the bottom tube plane 3 and the top tube plane 4 of the rear part 2. The front tube plane of the front part 1 is numbered 5. The left tube plane is numbered 6, the right tube plane is numbered 7, and the back tube plane of the tube system is numbered 8.

Figure 4:
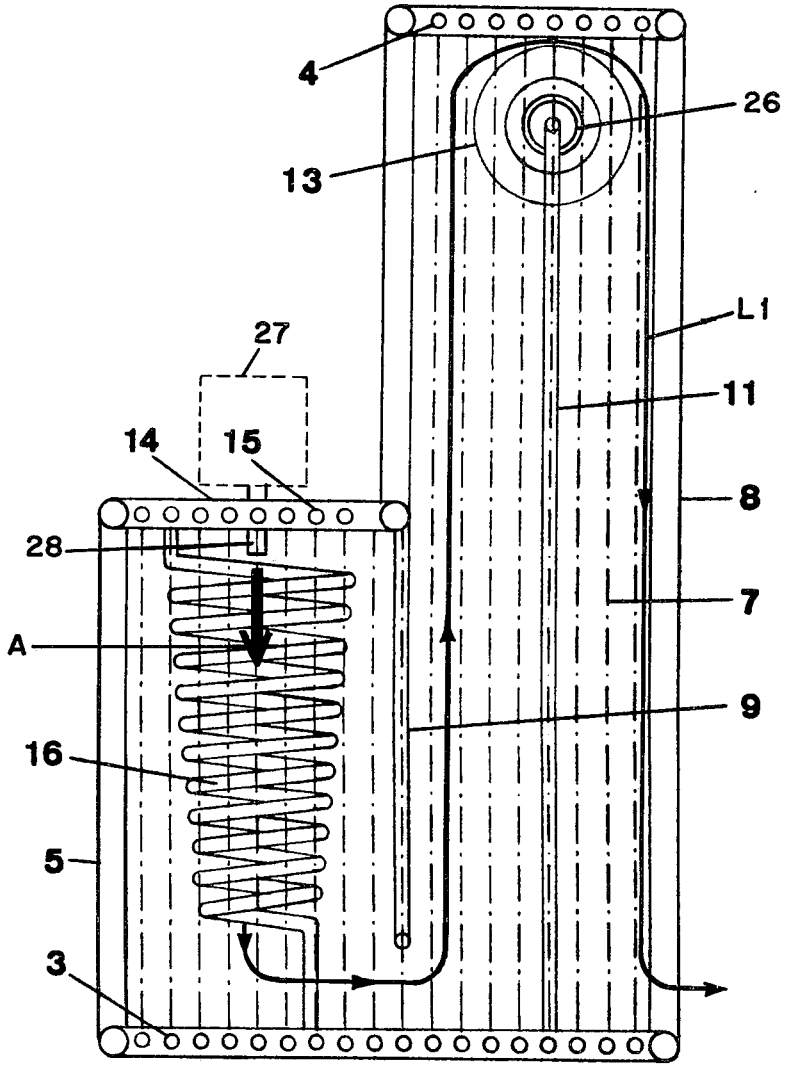
FIG. 4 is the furnace according to FIG. 2 in an enlarged scale and shows a tube system included in the furnace.

The front tube plane 9 of the upper rear part 2 extends downwardly to a level 10 which is a small distance above the bottom tube plane 3, forming there a lower flue gas opening (FIG. 5). A vertical tube plane, 11 (FIG. 6) is inserted between and parallel to the planes 8 and 9. This intermediary plane, having vertically directed tubes, extends from the bottom plane 3 and up to a level 12 (FIG. 5) which is a small distance below the top tube plane 4, forming there an upper flue gas opening (FIG. 5). A tight plate 25 is inserted parallel to, near to and behind the tube plane 11 (FIG. 6). This plate extends to the level 12. Connected to the upper end of the tube plane 11 and the plate 25 is a horizontally extended, cylinder-shaped hot-water tank 13 (FIG. 4), which communicates with the tube system and surrounds a tube spiral 26. The cold water enters the system through the tube spiral 26 which is enclosed in tank 13, thereby being heated by the hot water within the tank. Between the tank 13 and the top tube plane 4 is formed an opening for the flue gases. These gases (L1) flow upwardly on the left side of the tank, around this tank 13 and downwardly on the right side of the tank, according to FIG. 4.

On the top of the front part 1 is placed a downwardly directed burner 27, for instance operating with oil. Below the top there is room for horizontal tubes 15 according to FIG. 4. These, however, will be rather short tubes, if room is to be left for an oil-burner and therefore they can be omitted as is shown in FIGS. 5–7. Concentrically to the nozzle 28 of the burner and below the top 14 is placed a vertically directed tube spiral 16 in the form of a truncated cone having its smaller end directed downwardly. The spiral tubing communicates with the upper and lower frame parts 17 and 18 respectively of the front tube plane 5.

In operation, the flame (represented by arrow A, FIG. 4) of the oil-burner sweeps over the tube spiral 16 and most of the heat radiating from the flame is transferred to the tube spiral 16. For the other parts of the tube system most of the heat is transferred through convection when the hot flue gases (shown by a heavily inked line L1) sweep along the surfaces of the tube system. Due to the radiation heat, all soot on the tube spiral 16 is burnt away. The flue gases from the burner pass through the lower flue gas opening below the tube plane 9 and then rise between this tube plane 9 and the tube plane 11, sweep around the hot-water tank 13 and then stream downwardly between the plate (not shown) on the right side (according to FIG. 4) of the tube plane 11 and the back tube plane 8 to escape through the flue gas opening 19 (FIG. 6) in the lower end of the tube plane 8. In the left side tube plane 6 are two soot-holes 20 and 21.

Under test operation of a burner according to the invention and when comparing it with a conventional furnace, it has become evident that the burner according to the invention gives a considerable improvement of the fuel economy. The tests now made indicate that a reduction of the fuel consumption by at least 50% is possible.

This furnace was intended for use in a large villa and had the dimensions: width=325 mm, total depth=650 mm, of which the depth of the front part 1=325 mm, the height of the front part 1=400 mm, the height of the rear part 2=800 mm. The heating surface was 3.7 $m^2$ and the water volume of the tube system=17 liters. In order to have a still further improved fuel economy, it seems quite probable that for a normal house the dimensions of the furnace must be further reduced.

I claim:

1. A central heating furnace comprising an outer casing enclosing a closed system of tubes communicating with each other and containing a heat-carrying medium, said tube system having parts placed along at least the major areas of the inner walls of said casing, and burner means included in said furnace for heating said heat-carrying medium, said burner means having a nozzle means for generating a flame directed substantially vertically downwardly, said tube system further including a tube spiral having its length axis directed substantially in the same direction as said nozzle means and being shaped to surround said flame, said tube system includes a plurality of said tube positioned side by side to form planes having horizontally directed tubes along a bottom of said casing and along a top of the rear part of said casing and having vertically directed tubes along all sides, excluding a top of said front part and openings for discharging flue gas and enabling soot removal, the tube plane directly inside the vertical front side of said rear part extends downwardly far enough to leave only a lower opening for the flue gases to pass above the bottom tube plane, and between said vertical tube plane behind the front side of said rear part and the vertical back tube plane is inserted a vertical intermediary tube plane which is parallel to the two firstmentioned vertical planes and extending from the bottom tube plane and up to a level high enough to form a second flue gas opening below the top tube plane, said vertical intermediary tube plane having side facing said vertical covered with a tight plate, extending upwardly to the top of said vertical intermediary tube plane.

2. A furnace according to claim 1, characterized therein that said tube spiral has the form of a truncated cone, placed with the small end turned from said burner.

3. A furnace according to claim 1, characterized therein that said outer casing is shaped with a low box-like front part and a high box-like rear part, both having plane and spaced, parallel sides, said box-like front part containing the tube spiral and having the burner means placed on its top.

4. A furnace according to claim 1 and a horizontally extended, cylinder-shaped hot-water tank at the upper end of said vertical intermediary tube plane, the cylindrical shell of said hot-water tank being swept by the flue gases flowing upwardly along the side of said tight plate where said vertical intermediary tube plane is placed, then around said hot-water tank and after that downwardly on the opposite side of said tight plate to escape through an opening in the lower end of said back tube plane.

* * * * *